US011091934B2

(12) United States Patent
Roup et al.

(10) Patent No.: US 11,091,934 B2
(45) Date of Patent: Aug. 17, 2021

(54) APPARATUS AND METHOD FOR INSTALLING DOOR LOCKS

(71) Applicant: Schlage Lock Company LLC, Carmel, IN (US)

(72) Inventors: Austin Michael Roup, Woodland Park, CO (US); Kenton Hayes Barker, Colorado Springs, CO (US); Steve Verderaime, Colorado Springs, CO (US); David John Hurlbert, Manitou Springs, CO (US)

(73) Assignee: Schlage Lock Company LLC, Carmel, IN (US)

( * ) Notice: Subject to any disclaimer, the term of this patent is extended or adjusted under 35 U.S.C. 154(b) by 773 days.

(21) Appl. No.: 15/868,648

(22) Filed: Jan. 11, 2018

(65) Prior Publication Data

US 2019/0211581 A1 Jul. 11, 2019

(51) Int. Cl.
*E05B 9/08* (2006.01)
*E05B 9/02* (2006.01)

(52) U.S. Cl.
CPC . *E05B 9/08* (2013.01); *E05B 9/02* (2013.01)

(58) Field of Classification Search
CPC ..... E05B 9/08; E05B 9/02; E05B 3/04; E05C 5/04; F16B 13/0808; Y10T 292/62; Y10T 292/1099; Y10T 292/218; Y10T 292/221; Y10T 292/223; Y10T 292/858; Y10T 292/1033; Y10T 292/1094; Y10T 292/426
See application file for complete search history.

(56) References Cited

U.S. PATENT DOCUMENTS 1,297,539 A 3/1919 Bull
1,451,970 A * 4/1923 Taylor ..... B25B 31/005 411/418
2,517,364 A * 8/1950 Torresen ..... F16B 5/10 411/432
2,730,154 A * 1/1956 Aspey ..... F16B 39/32 411/321
2,828,662 A * 4/1958 Antal ..... F16B 37/085 411/437
3,157,215 A 11/1964 Zahodiakin
(Continued)

FOREIGN PATENT DOCUMENTS

DE 102019100398 A1 * 7/2020 ..... E05B 9/08
WO WO-2009107890 A1 * 9/2009 ..... F16B 37/085

OTHER PUBLICATIONS

McMaster-Carr Instruction sheet titled Expanding Diameter Quick-Release Pins, 1 page.
(Continued)

*Primary Examiner* — Christine M Mills
(74) *Attorney, Agent, or Firm* — Taft Stettinius & Hollister LLP

(57) ABSTRACT

An apparatus for releasably coupling a lock assembly to a structure. An inner housing and an outer housing are positioned on opposite sides of the structure. An elongate rod extends throughout the inner housing and into the outer housing. The elongate rod is configured to slide axially within an internal bore of the outer housing until a handle engages the inner housing. The elongate rod is configured to couple the inner and outer housing to the structure when the lever is rotated approximately one quarter of a full turn (90 degrees).

34 Claims, 10 Drawing Sheets

(56) References Cited

U.S. PATENT DOCUMENTS 3,192,820 A * 7/1965 Pitzer ..... F16B 13/065 411/33
3,813,756 A 6/1974 Rigsby et al.
3,842,877 A * 10/1974 Andrews ..... F16B 37/085 411/277
4,071,158 A 1/1978 Maheu
4,594,864 A 6/1986 Hart
4,781,507 A * 11/1988 Duenas ..... B25B 5/10 269/185
5,076,748 A * 12/1991 Waterfield ..... F16B 35/041 411/551
5,100,275 A 3/1992 Schirrmacher
5,106,251 A * 4/1992 Steinbach ..... F16B 37/085 292/251
5,548,982 A * 8/1996 Rawling ..... E05B 5/003 292/251
5,690,443 A * 11/1997 Sullivan ..... B42F 13/14 402/63
5,797,572 A * 8/1998 Schmucki ..... E03D 11/143 248/222.52
5,980,177 A 11/1999 Schiess et al.
6,223,572 B1 * 5/2001 Marttinen ..... E05B 9/002 292/348
6,279,360 B1 8/2001 Shen
6,302,457 B1 10/2001 Shen
6,364,383 B1 4/2002 Shen
6,745,602 B2 6/2004 Nakasone et al.
6,886,379 B2 5/2005 Simon et al.
6,979,029 B2 12/2005 Shen
7,334,767 B2 * 2/2008 Wright ..... B25B 13/46 248/342
7,347,463 B2 3/2008 Blight
7,571,941 B2 * 8/2009 Chang ..... E05B 9/08 292/347
7,628,366 B2 * 12/2009 Scott ..... F21V 21/04 248/317
7,682,120 B1 * 3/2010 Goldbaum ..... F16B 39/122 411/551
7,686,357 B2 3/2010 Engel et al.
7,780,135 B2 * 8/2010 Nelson ..... H04R 1/025 248/342
8,382,415 B1 * 2/2013 Goldbaum ..... F16B 37/085 411/551
8,511,948 B2 * 8/2013 Guy ..... B23B 31/113 408/239 R
8,720,156 B2 * 5/2014 Porter ..... E04F 13/0816 52/711
9,150,145 B2 * 10/2015 Wandelt ..... F16B 35/04
9,248,514 B2 * 2/2016 Piper ..... B23B 51/0473
10,561,999 B2 * 2/2020 Konietzko ..... B01F 7/161
2004/0057811 A1 * 3/2004 Kelzer ..... B23Q 3/12 411/389
2005/0254921 A1 11/2005 Leblanc
2011/0133050 A1 * 6/2011 Eisenberger, Sr. .... F16M 13/00 248/551
2013/0039715 A1 * 2/2013 Daykin ..... F16B 13/0808 411/21
2016/0084287 A1 * 3/2016 Daykin ..... F16B 37/042 411/174
2018/0243703 A1 * 8/2018 Konietzko ..... B01F 15/00733

OTHER PUBLICATIONS

Hoppe brochure titled Quick-Fit Plus, 8 pages.
Dorma Installation Instructions title CL700 Cylindrical Lever Lock, WD-0D002(061) Jan. 2003, 2 pages.
Carr Lane Instruction sheet titled Expanding Pins, 1 page.
Shur-Lok catalog titled Expandable Diameter Fasteners, 20 pages.
International Search Report; International Searching Authority; US Patent and Trademark Office; International Application No. PCT/US2019/013276; dated May 31, 2019; 4 pages.
Written Opinion; International Searching Authority; US Patent and Trademark Office; International Application No. PCT/US2019/013276; dated May 31, 2019; 9 pages.

* cited by examiner

APPARATUS AND METHOD FOR INSTALLING DOOR LOCKS

TECHNICAL FIELD

The present disclosure generally relates to a lock apparatus that can be assembled to a door or other structures without the use of tools such as screw drivers or the like.

BACKGROUND

Lock mechanisms with lever actuators are connected to movable structures such as doors or windows and the like to prevent unauthorized opening of the structure. Typically lock mechanisms require the use of tools and separate fasteners to install portions of the lock mechanism on either side of the movable structure. Some prior art lock mechanisms can be difficult and/or time consuming to install. Accordingly, there remains a need for further contributions in this area of technology.

SUMMARY

One embodiment of the present disclosure includes a lock mechanism with a quick connect feature that includes a lever handle connected to one of a Q-screw or an expanding shaft that permits installation of the lock mechanism without use of separate tools. Other embodiments include apparatuses, systems, devices, hardware, methods, and combinations for fastening portions of the lock mechanism to a movable structure with approximately a one quarter revolution turn of the lever. Further embodiments, forms, features, aspects, benefits, and advantages of the present application shall become apparent from the description and figures provided herewith.

BRIEF DESCRIPTION OF THE FIGURES

The description herein makes reference to the accompanying drawings wherein like reference numerals refer to like parts throughout the several views, and wherein.

DETAILED DESCRIPTION OF THE ILLUSTRATIVE EMBODIMENTS

Figure 1:
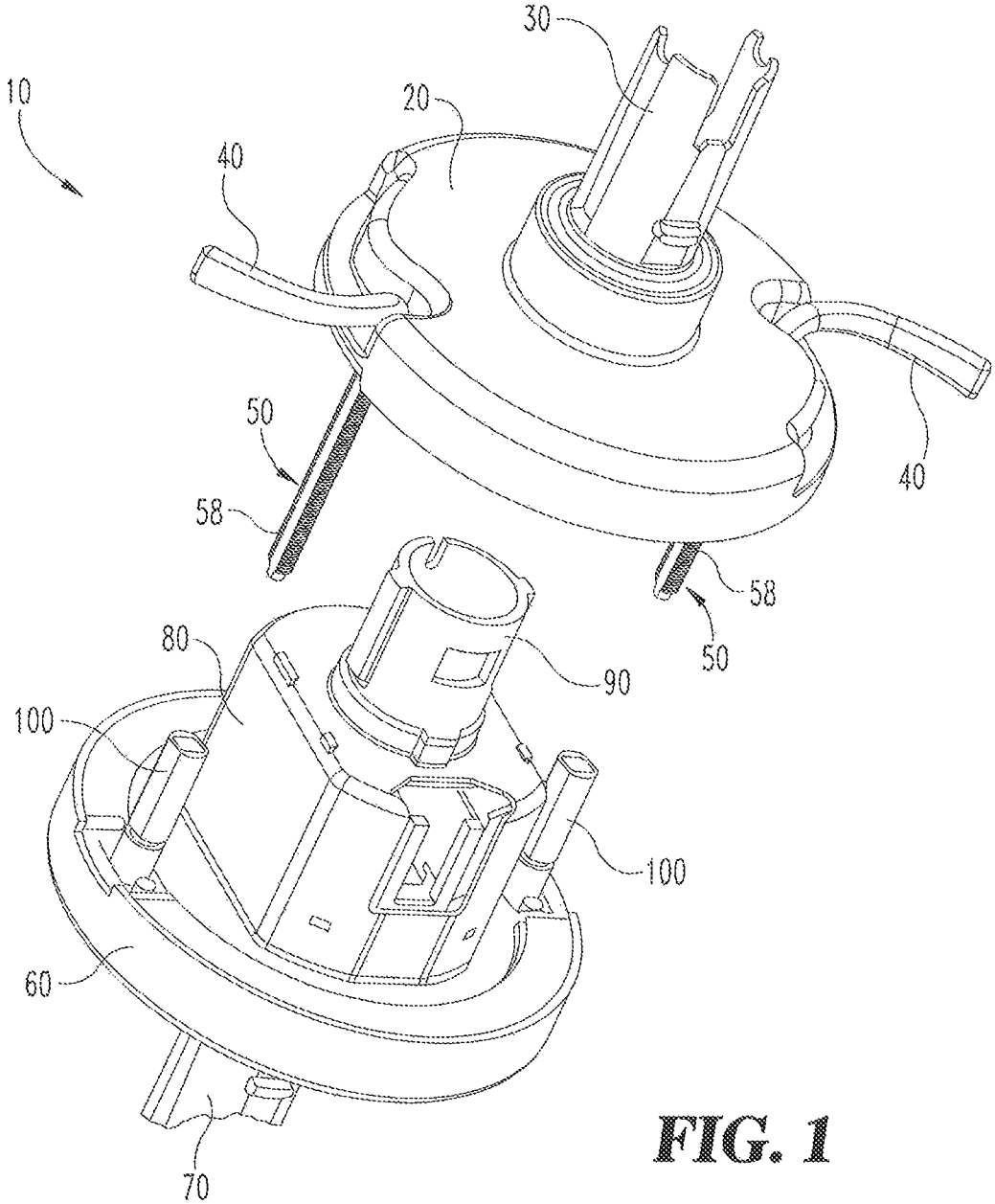
FIG. 1 is a perspective view of a portion of a lock assembly according to one embodiment of the present disclosure.

For purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to FIG. 1, a lock assembly 10 is shown in a perspective view with some components removed for clarity. The lock assembly 10 includes an inner spring cage housing 20 with an inner spindle 30 rotatably connected thereto. The inner spindle 30 may he connected directly or indirectly to an inner handle (not shown). The inner spring cage housing 20 can be coupled to an internal surface of a structure such as a door or the like (not shown). A lever 40 can include or be operably connected to a Q-screw 50 to provide a quick and simple means for coupling the lock assembly 10 to the structure without the use of separate tools. The lock assembly 10 may include one or more levers 40 in various embodiments. The Q-screw 50 can be defined by an elongate rod having a threaded shank portion 58 with intermittent threaded portions and non-threaded flat portions positioned therebetween. Each lever 40 is designed to require only a quarter turn (90°) to releasably hold or fix the lock assembly 10 to the movable structure.

An outer spring cage housing 60 complimentary to the inner spring cage housing 20 can be positioned on an external surface of the structure so as to receive the Q-screw 50 and couple together the inner and outer spring cage housings 20, 60. The outer spring cage housing 60 can include an outer spindle 70 rotatably extending therethrough and operably connectable with a lock mechanism 80. The outer spindle 70 may be connected directly or indirectly to an outer handle (not shown). A connector spindle 90 extends internally from the lock mechanism 80 to engage directly or indirectly with the inner spindle 30 of the inner spring cage housing 20.

A Q-post 100 can be connected to the outer spring cage housing 60 and is configured to receive a corresponding Q-screw 50. Each Q-screw 50 can slidingly engage within a corresponding Q-post 100 when the lever 40 is oriented in a first range of angular positions and can threadingly engage with the Q-post 100 in a second range of angular positions. The inner spring cage housing 20 can be attached to the outer spring cage housing 60 when the Q-screw 50 is threadingly engaged with the Q-post 100 The assembly and installation process will be described in greater detail below.

It should be noted that the Q-screw 50, Q-post 100 and other components described herein for use in quick installation applications are not limited to use with the exemplary lock assembly 10 illustrated herein, but may in fact be used with any type of handle or latch assembly, including those without internal lock mechanisms. Also, while the exemplary embodiment describes a non-limiting structure that includes two lever and Q-screw assemblies, it should be understood that the lock assembly 10 can include only one or more than two lever and Q-screw assemblies in alternate embodiments.

Figure 2:
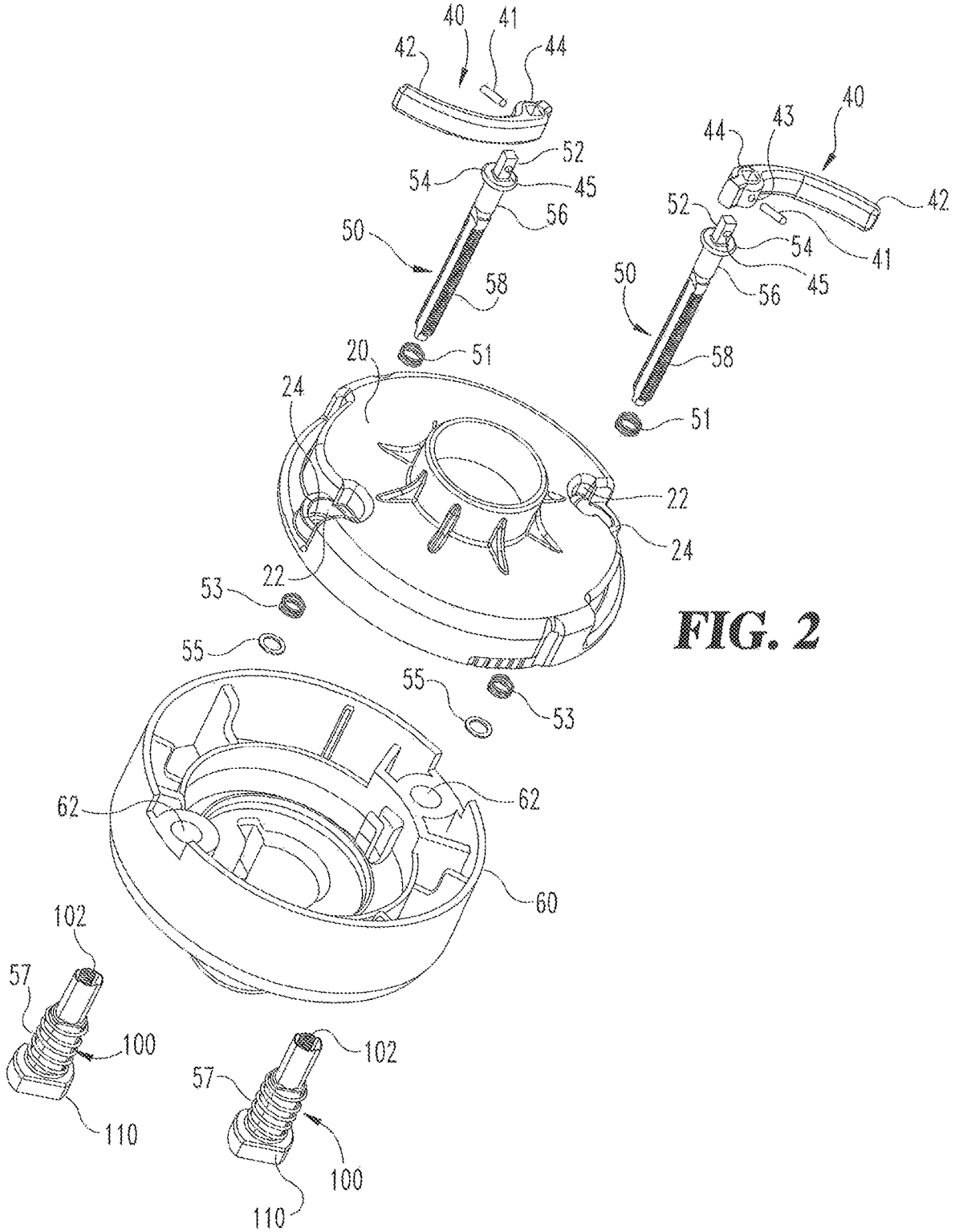
FIG. 2 is an exploded perspective view of portions of the lock assembly of FIG. 1.

Referring now to FIG. 2, the lever 40 can include a handle 42 with a pivot connection 44 formed at one end thereof. The Q-screw 50 can include a connection pin 52 configured to connect with the pivot connection 44 of the lever 40. The connection pin 52 can have a similar external shape to that of an internal shape of the pivot connection 44 in order to provide torque transfer capability between the handle 42 and the Q-screw 50. In the illustrative embodiment, the corresponding shape is square, however other forms are contemplated. In some embodiments the Q-screw 50 and the lever 40 can be constructed as a single integrally farmed component. A flange 54 can be positioned between the connection pin 52 and a pivot shank portion 56 of the Q-screw 50. The Q-screw 50 includes a threaded shank portion 58 extending from the pivot shank portion 56. As described above, the threaded shank portion 58 includes intermittent threaded portions alternating with non-threaded flat portions approximately every 90° or every quarter turn.

The threaded shank portion 58 of the Q-screw 50 is configured to be inserted through the lever receiver region 22 of the inner spring cage housing 20. An outer balance spring 51 can be positioned around threaded shank portion 58 so as to engage between the flange 54 of the Q-screw 50 and a spring support surface 24 formed in the lever receiving region 22 of the spring cage housing 20. An inner balance spring 53 can be positioned around the threaded shank portion 58 and can be constrained with a retaining ring 55. The inner balance spring 53 may be located within an adjacent intermediate structure such as door (see FIG. 4) of the lock assembly 10. The retaining ring 55 can be positioned adjacent the inner balance spring 53 to hold the inner balance spring 53 in position relative to the threaded shank portion 58 of the Q-screw 50. The inner and outer balance springs 51 and 53 are operable for permitting biaxial movement and for providing a bias force to urge the lever 40 into a desired axial position with respect to the inner and outer housings 20, 60 when the Q-screw 50 is in an unlocked (un-threaded) position.

In one form the outer spring cage housing 60 can include a post receiver region 62 for receiving a Q-post 100 therein. Each Q-post 100 includes a partially threaded internal bore 102 extending from a head 110. A load spring 57 can be positioned between the head 110 of the threaded Q-post 100 and the post receiver region 62 of the outer spring cage housing 60. The load spring 57 is operable for providing a desired bias force on the Q-post 100 and to position the Q-post 100 such that a desired clamping force is obtained when the Q-screw 50 is threadingly engaged with the Q-post 100. In some alternate embodiments the thread features of the Q-post 100 may be integrally formed with the outer spring cage housing 60 and thus eliminate the one or more separate Q-posts 100.

Figure 3:
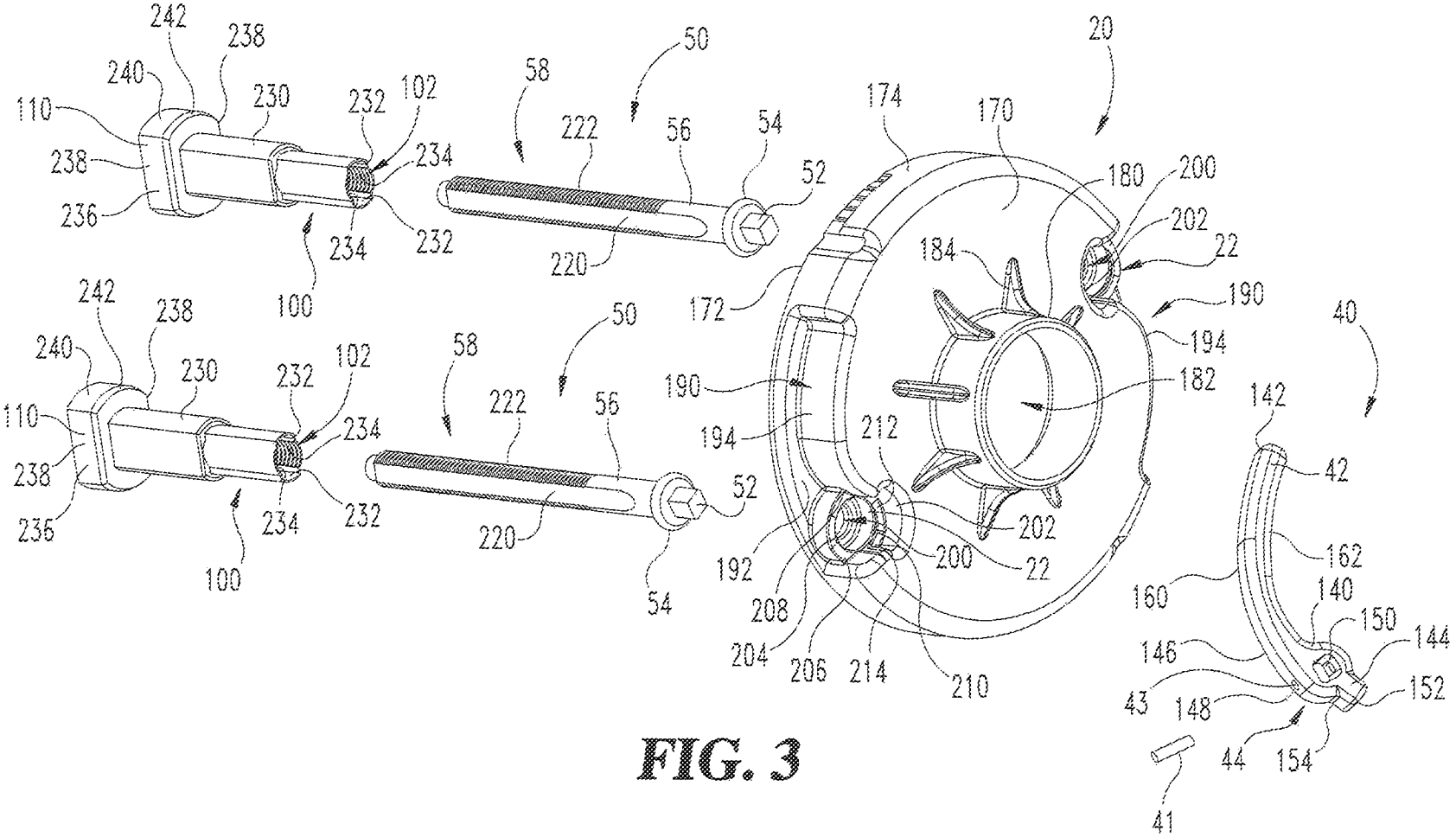
FIG. 3 is another exploded perspective view of portions of the lock assembly of FIG. 1.

Referring now to FIG. 3, a perspective view of a portion of the lock assembly 10 illustrating further details is shown. The lever 40 includes a lever handle (or handle) 42 extending from a first end 140 to a second end 142. The pivot connection 44 is constructed adjacent the first end 140 of the handle 42. The handle 42 includes a top wall 144 and an opposing bottom wall 146. A portion of the bottom wall 146 defines a first bearing surface 148 about a portion of the pivot connection 44 proximate the first end 140 of the handle 42. A connection aperture 150 extends through the top and bottom walls 144, 146 of the handle 42 and is constructed to receive the connection pin 52 of the Q-screw 50. In one form the shape of the connection aperture 150 can be square as illustrated in the exemplary embodiment, however other shapes and forms are contemplated by way of this disclosure.

A bearing lug 152 can extend outward from the pivot connection 44 generally in the opposite direction to the extension of the handle 42. The bearing lug 152 extends from the top wall 144 to the bottom wall 146 to define a second bearing surface 154 on the underside thereof. The handle 42 includes an outer wall 160 and an opposing inner wall 162 each extending between the top wall 144 and the bottom wall 146. In some forms the top, bottom, inner and outer walls 144, 146, 162 and 160 respective of the handle 42 can include portions that may be linear and other portions that may be curved. In other forms, the handle 42 can have regular cross-sectional shapes such as circular, elliptical square or other geometric shapes. In one form the handle 42 can have an arcuate shape extending from the first end 140 to the second end 142, as shown, however, other handle shapes are contemplated by the present disclosure.

The inner spring, cage housing 20 can include an outer side wall 170 and an opposing inner side wall 172 with an arcuate outer perimeter wall 174 extending between the outer side wall 170 and the inner side wall 172. In other forms the perimeter wall 174 may include one or more linear segments. The inner spring cage housing 20 further includes a spindle boss 180 projecting away from the outer side wall 170 to encompass a spindle aperture 182. The inner spindle 30 (FIG. 1) is configured to extend through the spindle aperture 182 when the lock assembly 10 is assembled. A plurality of support ribs 184 can be positioned around the spindle boss 180 and connected to the outer side wall 170 to provide additional support to the spindle boss 180.

A handle channel 190 is formed with the inner spring cage housing 20 in a portion of the outer perimeter wall 174. The handle channel 190 can include a base wall 192 and a shaped side wall 194 extending from the base wall 192 towards the outer side wall 170. In one form the shaped side wall 194 of the handle channel 190 substantially conforms with a shape of the handle 42. In the exemplary embodiment the shaped side wall 194 has a curved shape to conform with the arcuate shape of the handle 42. In this manner the lever 40 can be positioned substantially within a boundary defined by the handle channel 190 and thus remain substantially within an outer footprint of the inner spring cage housing 20. Other handle 42 shapes and corresponding handle channel shapes 190 are contemplated herein.

The lever receiving region 22 is formed at one end of the handle channel 190. The lever receiving region 22 includes a through aperture 200 to permit a corresponding Q-screw 50 to slide therethrough during assembly. A radial guide wall 202 extends partially around the through aperture 200 and is connected to the shaped side wall 194 of the handle channel 190 The shaped side wall 194 and the radial guide wall 202 can define a boundary with a substantially similar shape to that of the handle 42 and pivot connection 44 in one form of the illustrative embodiment.

The lever receiving region 22 further includes a first helical surface 204 extending between a first end 206 and second end 208 thereof. The helical surface 204 increases in height relative to the base wall 192 as the helical surface 204 traverses from the first end to the second end 206, 208 respectively (also shown in FIG. 5). A second helical surface 210 is formed opposite of the first helical surface 204 in the lever receiving region 22. The second helical surface 210 extends between a first end 212 and a second end 214. In similar fashion to the first helical surface 204, the second helical surface 210 is defined by an increasing height relative to the base wall 192 as the helical surface 210 traverses from the first end 212 to the second end 214 thereof. As the lever 40 is pivoted between open and closed positions, the first bearing surface 148 and the second bearing surface 154 of the pivot connection 44 slide along the first and second helical surfaces 204 and 210 of the handle 42 receiving region 22, respectively. The helical surfaces 204, 210 cause the lever 40 to move in an axially outward direction away from the outer spring cage housing 20 as the Q-screw 50 is threadingly engaged with the Q-post 100.

The threaded shank portion 58 of the Q-screw 50 includes threaded portions 222 intermittently spaced apart from one another and separated by unthreaded flat portions 2201. Each of threaded portions 222 and the flat portions 220 extend approximately 90° around the threaded shank portion 58. The Q-post 100 includes a shank 230 with a hollow internal bore 102 and a head 110 extending from one end thereof. The bore 102 includes opposing unthreaded portions 232 and opposing threaded portions 234 positioned between the unthreaded portions 232. The head 110 can include an outer wall 236 that may include one of a plurality of varying geometries. In one form the head 110 can include an opposing pair of flat edges 238 with a rounded surface 240 formed therebetween. In other forms the head 110 can include other geometric features such as a hex head or the like so as to provide anti-rotation features when assembled with the outer spring cage housing 60. In operation the Q-screw 50 can be slidingly engaged into the Q-post 100 in a first relative orientation wherein the threaded portions 222 of the Q-screw 50 are aligned with the unthreaded portions 232 of the Q-post 100 and then can be threadingly engaged with the Q-post by rotating the Q-screw 50 of approximately one-quarter of a revolution or 90°.

Figure 4:
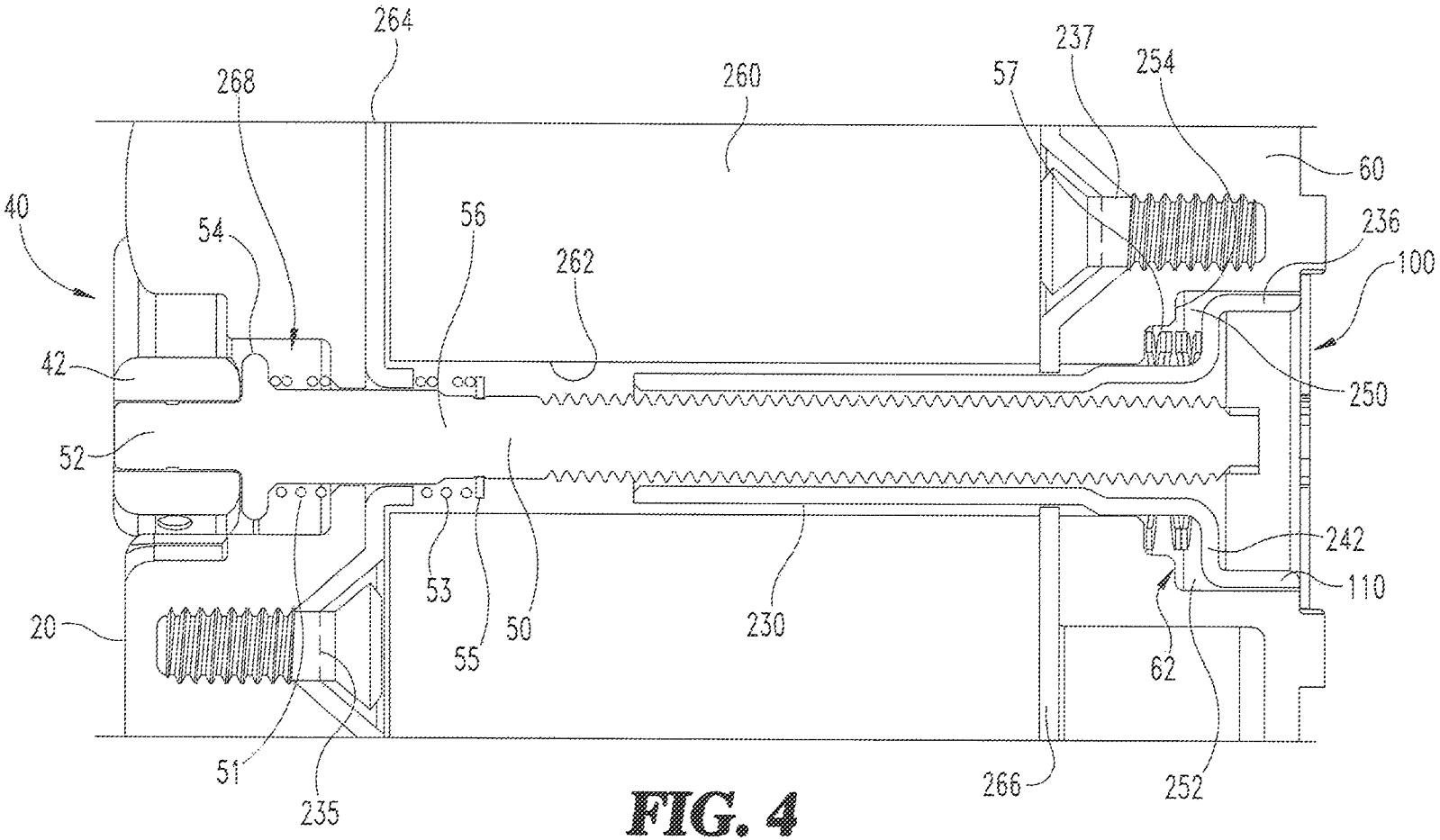
FIG. 4 is a cross-sectional view of a portion of the lock assembly of FIG. 1.

Referring now to FIG. 4 a cross-sectional view of a portion of the lock assembly 10 is illustrated. After the handle 42 is attached to the Q-screw 50 via the connecting pin 52, the Q-screw 50 can be inserted through the inner spring cage housing 20 and extend through an aperture 262 formed in an intermediate structure 260 such as a door or the like. A first support plate 264 can be positioned on one side of the intermediate structure 260 adjacent the inner spring cage housing 20. In one form, one or more fasteners 235 can be used to secure the first support plate 264 to the inner spring cage housing 20. A second support plate 266 can be positioned between the intermediate structure 260 and the outer spring cage housing 60. In one form one or more fasteners 237 can be used to secure the second support plate 266 to the outer spring cage housing 60.

The Q-post 100 can be inserted through the post receiving region 62 formed in the outer spring cage housing 60. The head 110 of the Q-post 100 includes a shoulder 242 extending radially outward from the shank 230 to the outer wall 236 of the head 110. A space 252 is formed between the shoulder 242 of the head 110 and an abutment edge 254 formed in the post receiving region 62 of the outer cage housing $0. The load spring 57 can be positioned about the shank 230 of the Q-post 100 within the space 252 formed between the shoulder 242 and the abutment edge 254 of the outer spring cage housing 60. The outer balance spring 51 can be positioned adjacent the flange 54 of the Q-screw 50 within a spring channel 268 formed in the inner spring cage housing 20. The inner balance spring 53 is positioned around the pivot shank portion 56 of the Q-screw 50 and is bounded by the retaining ring 55 and the first support plate 264. The inner and outer balance springs 53, 51 are operable for positioning the Q-screw 50 in a desired location relative the inner and outer spring cage housings 20, 60 as well as for providing a predetermined load force in the axial direction defined along a longitudinal length of the Q-screw 50 when installed with the structure 260. The load spring 57 provides increased tolerance flexibility along with a desired spring load to hold the inner and outer housing 20, 60 in a fixed location when installed with the structure 260.

Figure 5:
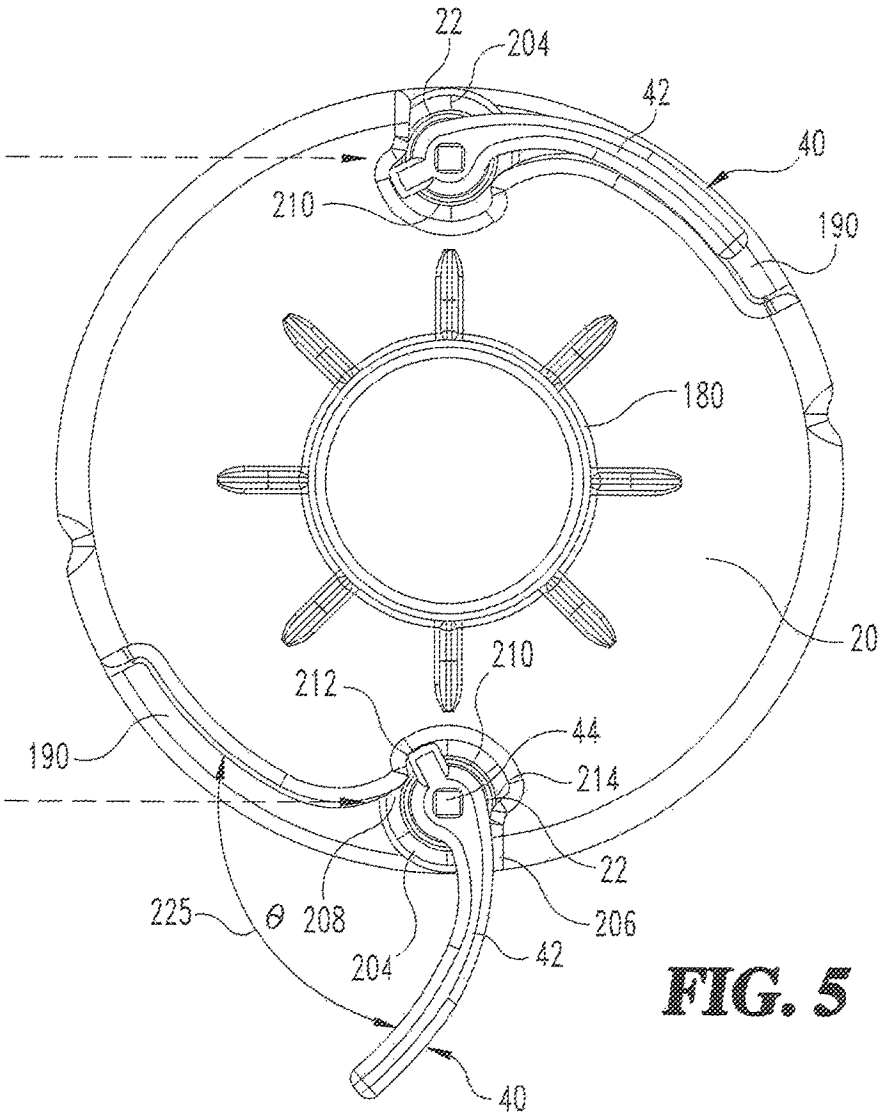
FIG. 5 is a top view of an inner spring cage housing with enlarged cross-sectional views of lever assemblies shown in a locked and an unlocked orientation.
Figure 5B:
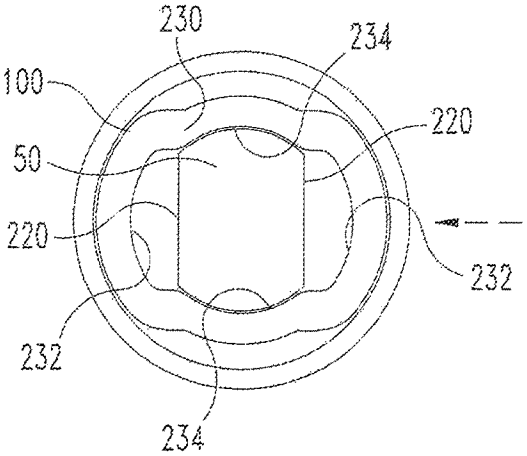
FIG. 5B is a cross-sectional view of a portion of the lever assembly of FIG. 5 in a locked orientation.
Figure 5A:
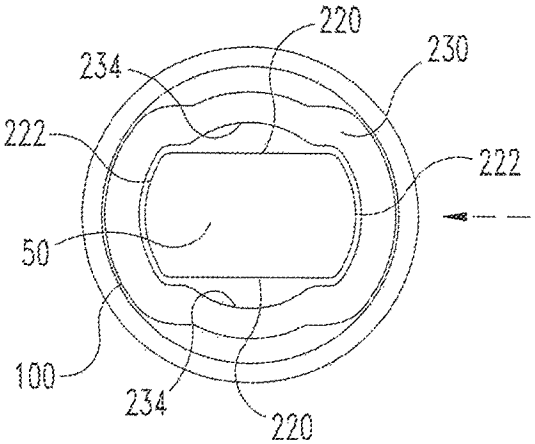
FIG. 5A is a cross-sectional view of a portion of the lever assembly of FIG. 5 in unlocked orientation.

Referring now to FIGS. 5, 5A and 58, the inner spring cage housing 20 is shown with one lever 40 in the closed or locked position at the top of the inner spring cage housing 20 (see FIG. 5B) and another lever 40 in an open or unlocked position at the bottom of the inner spring cage housing 20 (see FIG. 5A). The rotation angle e between the locked and unlocked orientations is represented by arrow 225. The total angle of rotation required to close the lever 40 is approximately 90° or one-quarter of a revolution. When a lever 40 is in the open or unlocked orientation (FIG. 5A) the Q-screw 50 can slide through the shank 230 of the Q-post 100 without interference between threaded portions of the Q-screw 50 and the Q-post 100. The threaded shank portion 58 of the Q-screw 50 can slide through the unthreaded portion 232 of the Q-post 100 in an axial direction when in the open orientation until the handle 42 is engaged with a portion of the inner spring cage housing 20.

The lever handle 42 may be moved axially inward until the bearing surfaces 148, 154 of the handle 42 (see FIG. 3) engages the helical bearing surfaces 204, 210 of the lever receiving region 22.

After t he lever handle 42 has engaged the helical surfaces 204, 210, the lever 40 can be rotated clockwise from the open position to the closed position. When the lever 40 is rotated to the closed position the thread portions 222 of the Q-screw 50 will engage with the threaded portions 234 of the Q-post 100 and draw the Q-screws 50 and the Q-post 100 together as is well understood (see FIG. 5B). As the Q-screw 50 and Q-post 100 are threaded together, the bearing surfaces 148 and 154 of the lever 40 will slidingly engage the helical bearing surfaces 204, 210 of the lever receiving region 22 respectively causing the handle 42 to move axially outward away from the outer spring cage housing 60. The helical surfaces 204, 210 provide for an increased clamping force between the Q-screw 50 and Q-post 100 when engaged with the inner and outer spring cage housings 20, 60 thereby permitting the lock assembly 10 to be assembled and fixed to a structure with only approximately a one-quarter turn of the lever 40. When lever 40 is locked, the lever handle 42 can nest within the handle channel 190 of the inner spring cage housing 22 so as to provide a visual indicator of a closed or locked condition as well as to permit other lock assembly structures (not shown) such as an escutcheon, plate or the like to be assembled therewith without interference.

Figure 6:
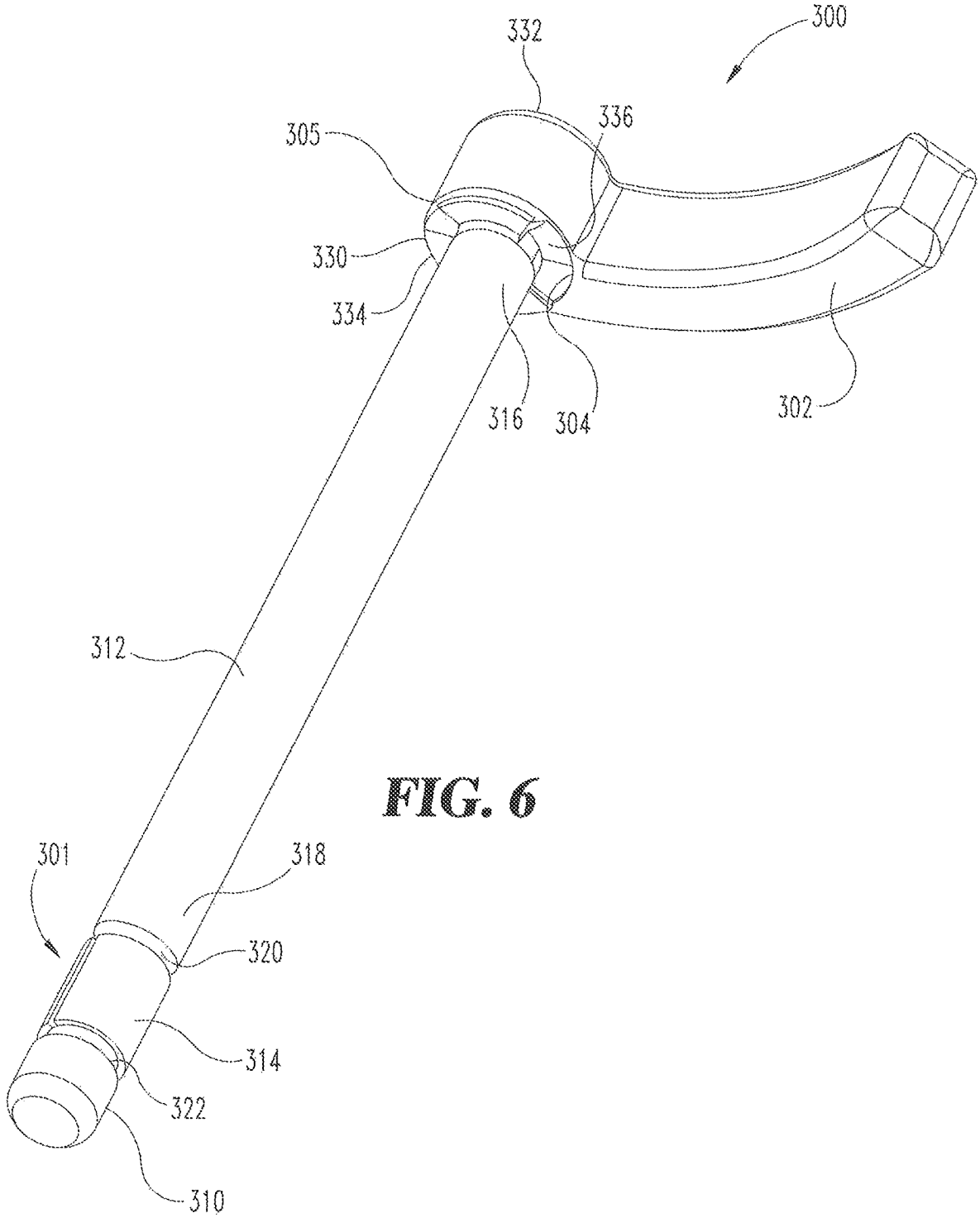
FIG. 6 is a perspective view of a lever mechanism according to another embodiment of the present disclosure.
Figure 7:
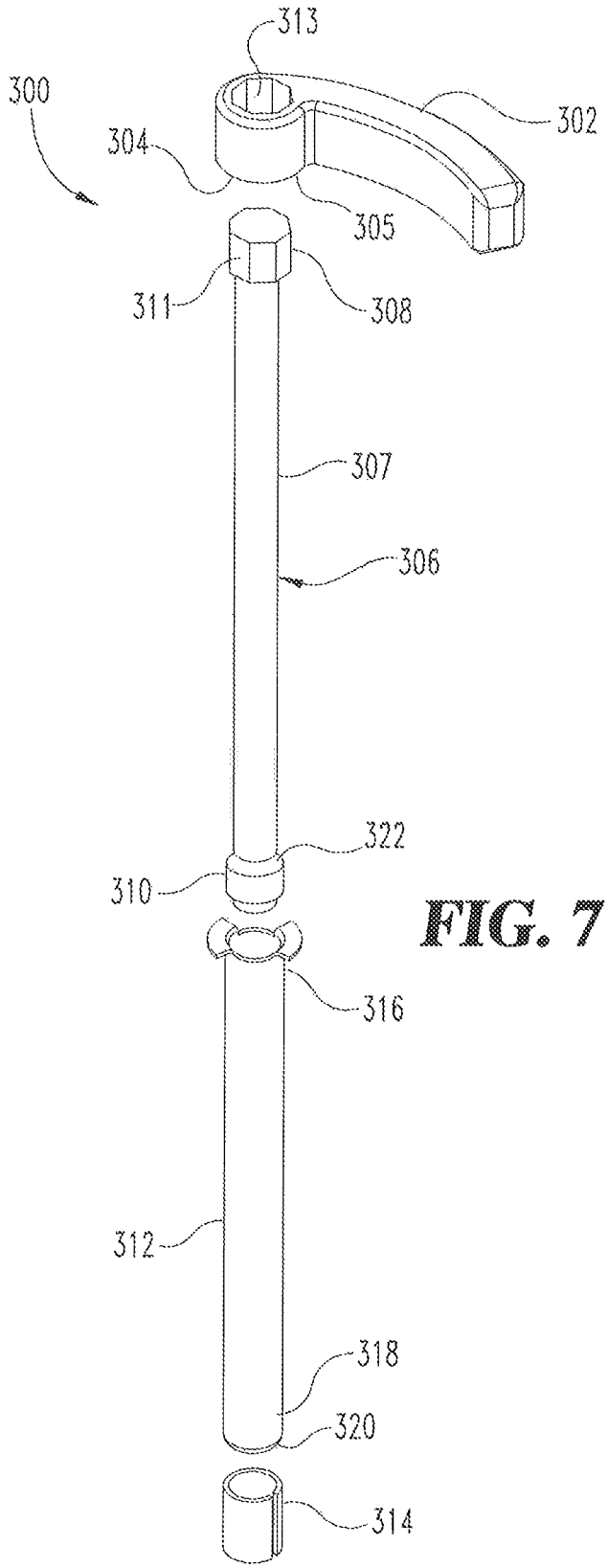
FIG. 7 is an exploded perspective view of the lever mechanism of FIG. 6.

Referring now to FIGS. 6 and 7, another embodiment of a lever mechanism 300 is illustrated. The lever mechanism 300 differs from the lever 40 with a threaded Q-screw 50 and Q-post 100 arrangement in that the quarter turn threads are replaced with a quarter turn press friction mechanism 301. The lever mechanism 300 includes a handle 302 with a helical surface 304 formed on the underside of a pivot region 305 of the handle 302. The helical surface 304 defines an engagement path 330 wherein a distance from a top 332 of the handle 302 increases from a first end 334 to a second end 336.

A clamp shaft 306 is connected at one end to the handle 302. The clamp shaft 306 includes an elongated shaft 307 with a first retainer 308 located at one end and a second retainer 310 located at the opposing end thereof. The first retainer 308 can include torque transmission connection means such as a hex head 311 or the like. A corresponding head receiving region 313 can be formed within the pivot region 305 of the handle 302 so that the handle 302 can transmit a rotational torque to the clamp shaft 306. Other means of torque connection may be used as one skilled in the art would readily understand.

A hollow post 312 having first and second ends 316, 318 can be slidingly engaged about the clamp shaft 306 such that the first end 316 is positioned adjacent the handle 302. A split ring 314 can be positioned about the clamp shaft 306 adjacent the second end 318 of the hollow post 312. The split ring 314 is retained between the second retainer 310 of the clamp shaft 306 and the hollow post 312. The second retainer 310 may be formed in a cylindrical shape with a larger outer diameter than that of the clamp shaft 306 and the outer diameter of the split ring 314 when in an unstressed condition. Other shapes or configurations of the second retainer 310 are contemplated herein. The spilt ring 314 can be expanded and slipped over the second retainer 310 and then released around the clamp shaft 306 during assembly.

In operation the lever mechanism 300 is assembled with the lock mechanism 10 such that the second retainer 310 is installed into a receiving region (not shown) formed within the outer spring cage housing 60. The helical surface 304 will engage with the inner spring cage housing 20 and move the shaft 306 and retainer 310 in an axial direction toward the split ring 314 such that the split ring 314 is "squeezed" between the hollow post 312 and the second retainer 310 when the handle 302 is rotated to a closed position. The hollow post 312 includes a tapered ramp 320 proximate the second end 318 and the second retainer 310 includes a tapered ramp 322 engageable with the split ring 314 when the handle 302 is rotated to a closed position. The tapered ramps 320, 322 operate to expand the split ring 314 radially outward to a larger diameter as the hollow post 312 moves toward the split ring 314 due to rotation of the handle 302. The expanded split ring 314 will engage and create a friction press fit condition with a surrounding structure (not shown) defined in the outer spring cage housing 60 (FIG. 1) and thus lock the inner and outer spring cage housings 20, 60 together with approximately one-quarter turn of the handle 302.

Figure 8:
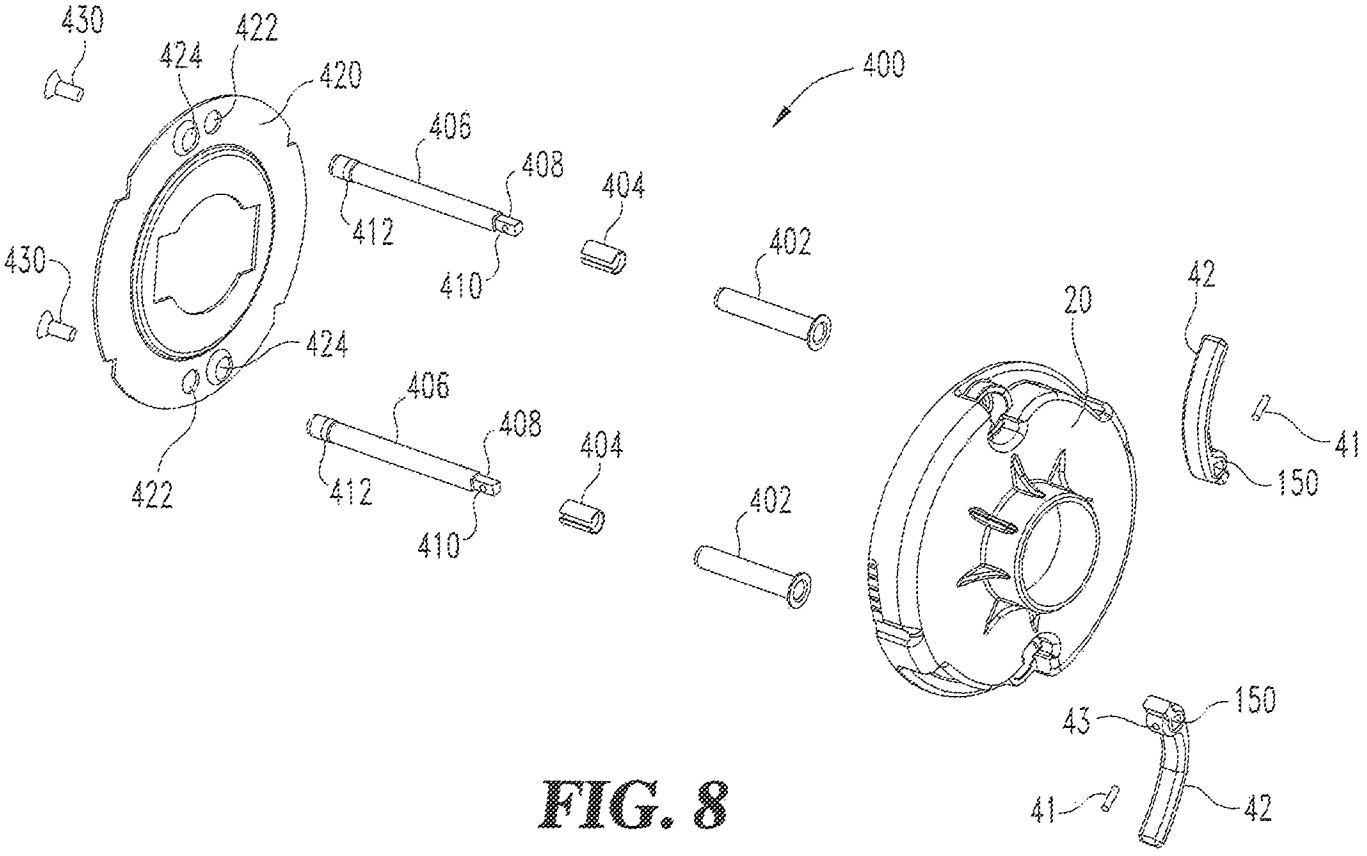
FIG. 8 is an exploded perspective view of a lock assembly according to another embodiment of the present disclosure.
Figure 9:
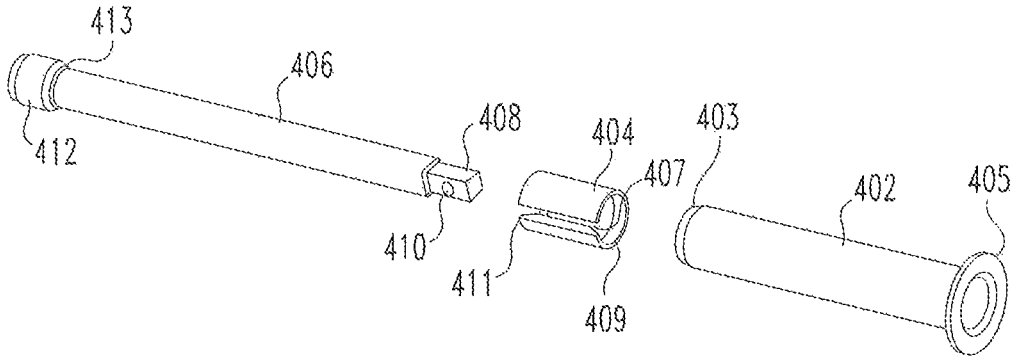
FIG. 9 is an enlarged perspective view of a portion of FIG. 8.
Figure 10:
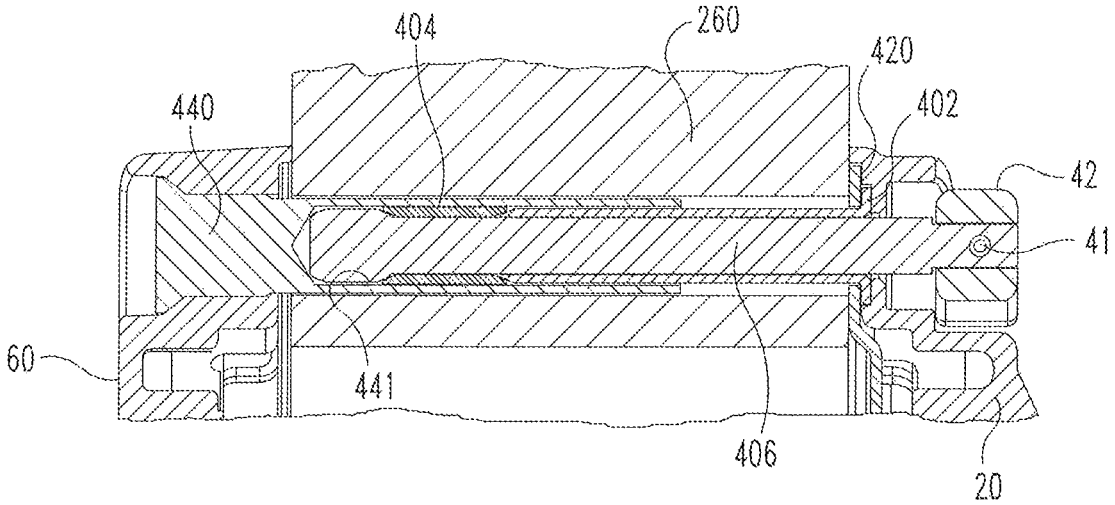
FIG. 10 is a cross-section view of FIG. 8.

Referring now to FIGS. 8, 9 and 10, a lock assembly 400 according to another embodiment is shown in exploded perspective views and in cross-section. The lock assembly 400 includes an inner spring cage housing 20 that is substantially similar to the inner spring cage housing described in the previous embodiments. The lever handles 42, also substantially similar to those described in the previous embodiments, can be rotationally coupled to the inner cage housing 20. A hollow sleeve 402 and split ring 404 can be slidingly engaged adjacent one another around the clamp shaft 406. The hollow sleeve 402 can include a tapered ramp 403 positioned to engage the split ring 404 on one end and a flange 405 extending from an opposing end thereof. The split ring 404 includes an open slot 407 extending between a first end 409 and a second end 411 thereof. A tapered ramp 413 formed on the wedge retainer 412 is configured to engage the second end 411 of the split ring.

The clamp shaft 406 can extend through the inner spring cage housing 20 such that the lever handle 42 can be connected via a connecting pin 41. A connecting pin 41 can extend through an aperture 43 formed in each of the handles 42 and into an aperture 410 extending through a connecting portion 408 of the clamp shaft 406. A wedge retainer 412 is formed on a distal end of the clamp shaft 406 so as to provide a means for engaging and expanding the split ring 404. Similar to the operation described in previous embodiments, when the handle 42 is moved from an open position to a closed position, the split ring 404 will be expanded to lock the lock assembly 400, as is described below in more detail. An inner plate 420 is configured to slide over each of the clamp shafts 406 and connect to the inner cage housing 20 with one or more fasteners 430. The inner plate 420 can include one or more through apertures 422, 424 for permitting the threaded fasteners 430 and the clamp shafts 400 to extend therethrough.

Referring more specifically to FIG. 10, one or more clamp posts 440 can be operably engaged within the outer spring cage housing 60. Each clamp post 440 is configured to receive a clamp shaft 406, a split ring 404 and a portion of a hollow sleeve 402 within an internal bore 441 thereof in an assembled position. The outer spring cage housing 60 and the inner spring cage housing 20 can be connected to an intermediate structure 260, such as a door or the like when locked together.

In operation, the tapered ramp 413 of the wedge retainer 412 and the tapered ramp 403 of the hollow sleeve 402 will engage and "squeeze" the split ring 404 therebetween as the handle 42 is rotated from an open position to a closed position. The clamp shaft 406 is drawn toward the inner spring cage housing 20 as the handles 42 moves along the helical surfaces of the inner spring cage housing 20 as described in previous embodiments. When the split ring 404 is squeezed between the wedge 412 of the clamp shaft 406 and the tapered ramp 403 of the hollow sleeve 402, the split ring is forced to expand radially outward. As the diameter of split ring 404 increases, a press fit between the split ring 404 and the inner bore 441 of the clamp post 440 will prevent the inner spring cage housing 20 and the outer spring cage housing 60 from being separated from the intermediate structure 260.

Figure 11:
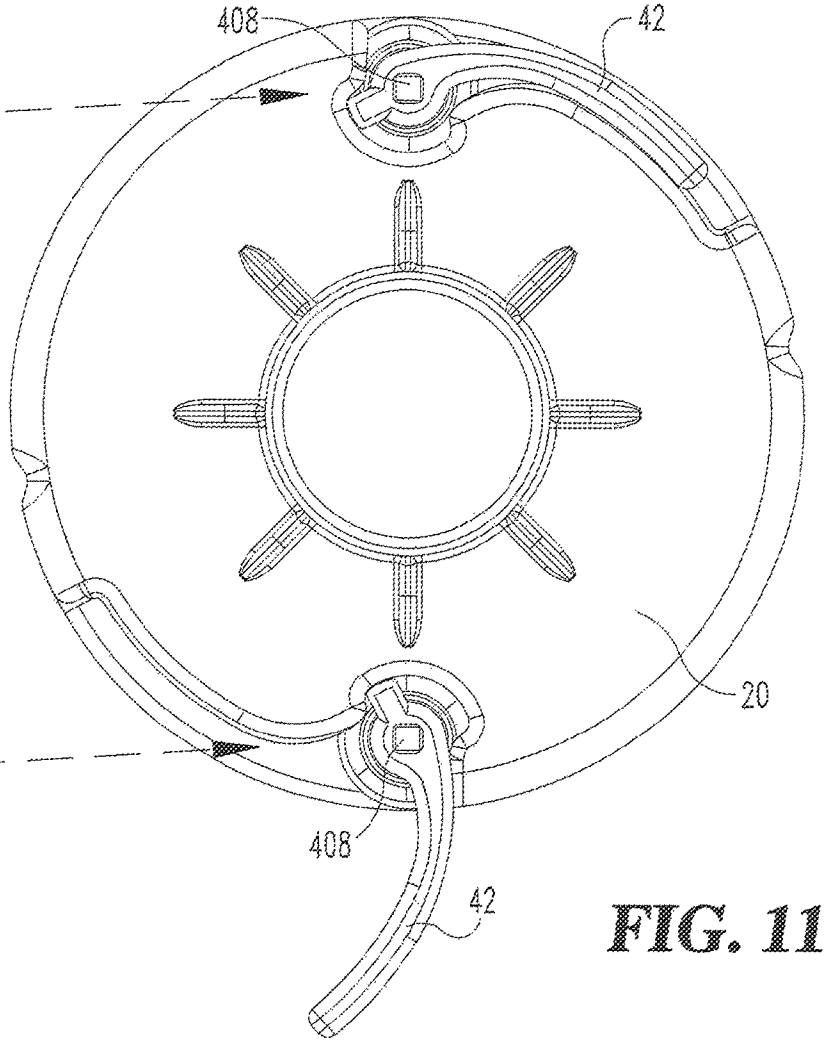
FIG. 11 is a front view of an inner spring cage housing for the locking mechanism of FIG. 8.
Figure 11B:
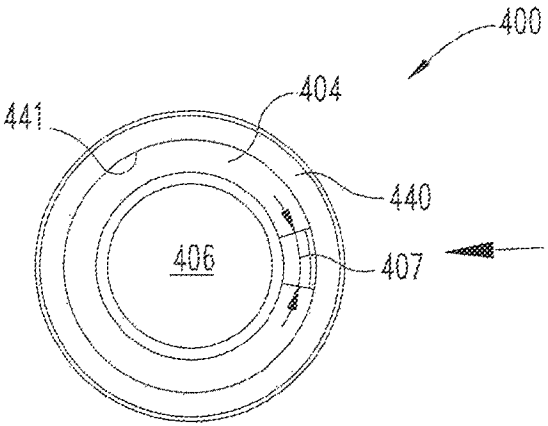
FIG. 11B is a cross-section view of the locking mechanism in a locked position.
Figure 11A:
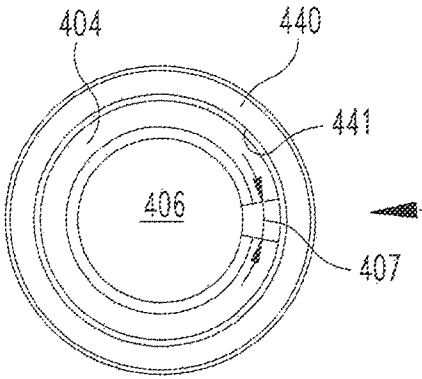
FIG. 11A is a cross-sectional view of the locking mechanism in an unlocked position.

Referring now to FIGS. 11, 11A and 11B, cross-sectional views of the lock assembly 400 in a locked and unlocked configuration is illustrated. The lower handle 42 is shown in an open position which corresponds to the unlocked configuration of FIG. 11A and the upper handle 42 is shown in a closed position, which corresponds to locked configuration of FIG. 11B. FIG. 11A shows a cross-sectional view of the split ring 404 and the clamp shaft 406 in an unlocked condition wherein the slot 407 of the split ring 404 has not expanded into a press fit condition with the clamp post 440. FIG. 11B shows the split ring 404 with an expanded slot 407 which causes the diameter of the split ring 404 to expand and press against the inner bore 441 of the clamp post 440 and lock the inner arid outer spring cage housings 20, 60 to the structure 260 (see FIG. 10).

In one aspect, the present disclosure includes a lock assembly comprising; an inner housing positionable on one side of a structure; an outer housing positionable on an opposing side of the structure; a Q-screw having alternating threaded portions and non-threaded portions intermittently formed about a shank; a Q-post engaged with the outer housing, the Q-post including an internal bore with alternating threaded portions and non-threaded portions formed therein; and wherein the Q-screw is configured to slidingly move within the internal bore of the Q-post in a first angular orientation and threadingly engage the Q-post in a second angular orientation.

In refining aspects, the Q-screw couples the inner and outer housings to the structure when rotated approximately one quarter revolution turn (90°) from the first angular orientation; wherein a handle is connected to the Q-screw at one end thereof; wherein in the inner housing includes a handle channel formed at least partially with a base wall and a shaped sidewall extending between the base wall and a top wall of the inner housing; wherein the shaped sidewall of the handle channel and a shape of the handle are substantially similar; wherein the inner housing includes a lever receiving region defined by: an aperture extending through the side wall; a first helical surface formed partially around the aperture extending between first and second ends; a second helical surface formed partially around the aperture extending between first and second ends; and wherein a height of the first and second helical surfaces relative to the base wall increases from the first end to the second end of each of the first and second helical surfaces; wherein the handle includes a first bearing surface engagable with the first helical surface of the lever pivot region; wherein the handle includes a lug extending from the pivot region generally in the opposite direction of the handle; wherein the handle includes a second bearing surface on one side of the lug that is engagable with the second helical surface of the lever pivot region; wherein the first and second helical surfaces move the Q-screw in an axial direction during rotation; further comprising: an outer balance spring positioned about the Q-screw between a flange on the Q-screw and the inner housing; and an inner balance spring positioned about the Q-screw between a retaining ring and the inner housing; further comprising a load spring engaged between the Q-post and the outer housing.

Another aspect of the present disclosure includes an apparatus for releasably coupling a lock assembly to a structure, the apparatus comprising: an inner housing including a lever receiving region with an aperture extending therethrough, the inner housing positioned on one side of the structure; an outer housing including an internal bore positioned on an opposing side of the structure; an elongate rod extending through the aperture of the inner housing and into the internal bore in the outer housing; a lever handle connected to one end of the rod; wherein the rod is configured to slide axially within the internal bore in a first angular orientation until the lever handle engages the inner housing, the rod further configured to couple the inner and outer housing to the structure when rotated approximately one quarter of a full turn (90 degrees) from the first angular orientation.

In refining aspects, the elongate rod includes a Q-screw defined by a shank with a pair of opposing threaded portions formed in approximately 90° angular segments and non-threaded portions located between the threaded portions thereof; and wherein the internal bore is part of a Q-post defined by a pair of opposing threaded portions formed in approximately 90° angular segments and non-threaded portions located between the threaded portions thereof; and wherein the Q-screw is configured to slide axially within the bore of the Q-post in a first relative angular orientation and to threadingly engaged within the bore of the Q-post when in a second relative angular orientation; wherein the elongate rod is defined by a split ring shaft configured to expand and engage an internal portion of the bore when the lever is rotated in a first direction; wherein the spilt ring shaft is defined by: a clamp shaft with first and second retainer members on either end; a hollow post positioned about the clamp shaft and a split ring positioned about the clamp shaft between the hollow post and the second retainer member; wherein the split ring shaft includes a handle with a helical surface configured to engage the inner housing and move first retainer member toward the split ring when the lever is rotated in the first direction.

Another aspect of the present disclosure includes a method comprising: coupling a Q-post to an outer housing; positioning the outer housing adjacent an outer wall of a structure; positioning an inner housing adjacent, an inner wall of the structure; coupling a handle to a Q-screw; wherein the Q-screw and an internal bore of the Q-post are defined by segmented threaded regions separated by non-threaded regions; moving the Q-screw to a first angular orientation relative to the Q-post; sliding the Q-screw through an aperture formed in an inner housing and into the internal bore of the Q-post until the handle contacts the inner housing; rotating the handle approximately ninety degrees (¼ turn) from the first angular orientation; engaging the segmented threads of the Q-screw with the threads of the Q-post in response to the rotating of the handle; and clamping the inner and outer housings to the structure in response to the treaded engagement of the Q-screw with the Q-post.

In refining aspects, the method further includes slidingly engaging a portion of the handle with a helical surface formed on the inner housing during the rotating; further comprising moving the Q-screw in an axial direction away from the outer housing as the handle moves along the helical surface from a first end toward a second end during the rotating.

In another aspect, the present disclosure includes a lock assembly comprising: an inner housing positionable on one side of a structure; an outer housing positionable on an opposing side of the structure; an inner housing including a lever receiving region with an aperture extending therethrough; an internal bore formed with the outer housing; a spilt ring shaft extending through the aperture of the inner housing and into the internal bore in the outer housing; a handle connected to one end of the spilt ring shaft; wherein the spilt ring shaft is configured to slide axially within the internal bore until the handle engages with the inner housing, the spilt ring connector shaft further configured to couple the inner and outer housing to the structure when rotated approximately one quarter of a full turn (90 degrees).

In refining aspects, the spilt ring shaft comprises: a clamp shaft with first and second retainer members located on either end; a hollow post positioned about the clamp shaft; and a split ring positioned about the clamp shaft between the hollow post and the second retainer member; and wherein split ring is configured to expand and engage an internal wall of the bore when the lever is rotated from an open position to a closed position.

In another aspect, the present disclosure includes a lock assembly comprising; an inner housing positionable on one side of a structure; an outer housing positionable on an opposing side of the structure; a clamp shaft defined by an elongate rod having a wedge element positioned at one end and a connecting, member positioned at an opposing end; a cylindrical sleeve engaged around outer perimeter wall of the elongate rod; a split ring engaged around outer perimeter wall of the elongate rod between the cylindrical sleeve and the wedge member; a clamp post engaged with the outer housing, the clamp post having an internal bore configured receive a portion of the clamp shaft, the split ring and the sleeve therein; wherein the spit ring is configured to expand and press against the internal bore of the clamp post in a locked condition.

In refining aspects, the lock assembly comprises: a handle connected to the connecting member of the clamp shaft; and wherein the clamp shaft locks the inner and outer housings to the structure when the handle is rotated approximately one quarter of a revolution turn (90°); wherein the wedge element and the cylindrical sleeve each include a tapered ramp formed on one end thereof; wherein the tapered ramp of the wedge element and the tapered ramp of the cylindrical sleeve cooperate to engage and expand the split ring when the handle is rotated to a locked position; wherein the inner housing includes a lever receiving region defined by: an aperture extending through a side wall; a first helical surface formed partially around the aperture extending between first and second ends; a second helical surface formed partially around the aperture extending between first and second ends; and wherein a height of the first and second helical surfaces relative to the base wall increases from the first end to the second end of each of the first and second helical surfaces; wherein the handle includes bearing surfaces engagable with the first and second helical surfaces of the lever pivot region; and the first and second helical surfaces of the lever pivot regions cause the clamp shaft to move in an axial direction toward the inner housing when the handle is rotated to a locked position.

It should be understood that the component and assembly configurations of the present disclosure can be varied according to specific design requirements and need not conform to the general shape, size, connecting means or general configuration shown in the illustrative drawings to fall within the scope and teachings of this patent application.

While the invention has been described in connection with what is presently considered to be the most practical and preferred embodiment, it is to be understood that the invention is not to be limited to the disclosed embodiment (s), but on the contrary, is intended to cover various modifications and equivalent arrangements included within the spirit and scope of the appended claims, which scope is to be accorded the broadest interpretation so as to encompass all such modifications and equivalent structures as permitted under the law. Furthermore, it should be understood that while the use of the word preferable, preferably, or preferred in the description above indicates that feature so described may be more desirable, it nonetheless may not be necessary and any embodiment lacking the same may be contemplated as within the scope of the invention, that scope being defined by the claims that follow. In reading the claims it is intended that when words such as "a," "an," "at least one" and "at least a portion" are used, there is no intention to limit the claim to only one item unless specifically stated to the contrary in the claim. Further, when the language "at least a portion" and/or "a portion" is used the item may include a portion and/or the entire item unless specifically stated to the contrary.

What is claimed is:

1. A lock assembly, comprising:

an inner housing positionable on one side of a structure;

an inner spindle rotatably connected to the inner housing and configured for coupling to an inner handle;

an outer housing positionable on an opposite side of the structure;

an outer spindle rotatably connected to the outer housing and configured for coupling to an outer handle;

a screw having alternating threaded portions and non-threaded portions intermittently formed about a shank; and a post engaged with the outer housing, the post including an internal bore with alternating threaded portions and non-threaded portions formed therein; and wherein the screw is configured to slidingly move within the internal bore of the post in a first angular orientation and threadingly engage the post in a second angular orientation to interconnect the inner housing with the outer housing; and wherein rotation of the screw between the first angular orientation and the second angular orientation causes sliding engagement between a portion of the screw and the inner housing along a helical surface to provide an increased clamping force between the screw and the post.

2. The lock assembly of claim 1, wherein the screw couples the inner housing and the outer housing to the structure when rotated approximately one quarter revolution (90°) from the first angular orientation.

3. The lock assembly of claim 1, wherein the portion of the screw slidably engaged with the inner housing comprises a handle connected to the screw at one end thereof.

4. The lock assembly of claim 3, wherein the inner housing includes a handle channel formed at least partially in a base wall and a shaped sidewall extending between the base wall and a top wall of the inner housing.

5. The lock assembly of claim 4, wherein the shaped sidewall and a shape of the handle are substantially similar to one another.

6. The lock assembly of claim 3, wherein the inner housing includes a lever receiving region defining an aperture extending through a side wall of the inner housing;

wherein the helical surface is defined by the inner housing and comprises:

a first helical surface formed partially around the aperture and extending between first and second ends; and a second helical surface formed partially around the aperture and extending between first and second ends; and wherein a height of the first helical surface and the second helical surface relative to the side wall increases from the first end to the second end of each of the first helical surface and the second helical surface.

7. The lock assembly of claim 6, wherein the handle includes a first bearing surface engagable with the first helical surface of the lever receiving region.

8. The lock assembly of claim 6, wherein the handle includes a lug extending from the lever receiving region in a direction generally opposite the handle.

9. The lock assembly of claim 8, wherein the handle includes a second bearing surface on a side of the lug that is engagable with the second helical surface of the lever receiving region.

10. The lock assembly of claim 6, wherein the first helical surface and the second helical surface move the screw in an axial direction during rotation.

11. The lock assembly of claim 1, further comprising a load spring engaged between the post and the outer housing.

12. The lock assembly of claim 1, further comprising:

first and second ones of the screw; and first and second ones of the post engaged with the first and second ones of the screw, respectively, to interconnect the inner housing with the outer housing.

13. The lock assembly of claim 1, further comprising:

a lock mechanism coupled between the inner spindle and the outer spindle;

an inner handle coupled to the inner spindle; and an outer handle coupled to the outer spindle.

14. The lock assembly of claim 1, further comprising an aperture extending through the inner housing and the helical surface formed at least partially about the aperture.

15. The lock assembly of claim 1, wherein the inner spindle and the outer spindle rotate about an axis of rotation; and wherein the screw and the post are positioned along a longitudinal axis offset from the axis of rotation.

16. A lock assembly, comprising:

an inner housing positionable on one side of a structure;

an inner spindle rotatably connected to the inner housing and configured for coupling to an inner handle;

an outer housing positionable on an opposite side of the structure;

an outer spindle rotatably connected to the outer housing and configured for coupling to an outer handle;

a screw having alternating threaded portions and non-threaded portions intermittently formed about a shank;

a post engaged with the outer housing, the post including an internal bore with alternating threaded portions and non-threaded portions formed therein;

an outer balance spring positioned about the screw between a flange on the screw and the inner housing; and an inner balance spring positioned about the screw between a retaining ring and the inner housing; and wherein the screw is configured to slidingly move within the internal bore of the post in a first angular orientation and threadingly engage the post in a second angular orientation to interconnect the inner housing with the outer housing.

17. An apparatus for releasably coupling a lock assembly to a structure, the apparatus comprising:

an inner housing including a lever receiving region with an aperture extending therethrough, the inner housing positioned on one side of the structure;

an inner spindle rotatably connected to the inner housing and configured for coupling to an inner handle;

an outer housing including an opening positioned on an opposite side of the structure;

an outer spindle rotatably connected to the outer housing and configured for coupling to an outer handle;

an elongate rod extending through the aperture of the inner housing and into the opening of the outer housing; and a lever handle connected to one end of the elongate rod; and wherein the elongate rod is configured to slide axially within the opening in a first angular orientation until the lever handle engages the inner housing, the elongate rod further configured to couple the inner housing and the outer housing to the structure when rotated approximately one quarter of a full turn (90 degrees) from the first angular orientation to a second angular orientation to interconnect the inner housing with the outer housing; and wherein rotation of the elongate rod between the first angular orientation and the second angular orientation causes sliding engagement between the lever handle and the inner housing along a helical surface to provide an increased clamping force between the inner housing and the outer housing.

18. The apparatus of claim 17, wherein the elongate rod includes a screw defined by a shank with a pair of opposite threaded portions formed in approximately 90° angular segments, and non-threaded portions located between the threaded portions;

wherein the opening of the outer housing comprises an internal bore of a post which includes a pair of opposite threaded portions formed in approximately 90° angular segments and non-threaded portions located between the threaded portions; and wherein the screw is configured to slide axially within the bore of the post in the first angular orientation and to be threadingly engaged within the bore of the post when in the second angular orientation.

19. The apparatus of claim 17, wherein the elongate rod is defined by a split ring shaft configured to expand and engage an internal portion of the bore when the lever handle is rotated between the first angular orientation and the second angular orientation.

20. The apparatus of claim 19, wherein the split ring shaft is defined by:

a clamp shaft having first and second retainer members on either end of the clamp shaft;

a hollow post positioned about the clamp shaft; and a split ring positioned about the clamp shaft between the hollow post and the second retainer member.

21. The apparatus of claim 20, wherein the split ring shaft includes the helical surface configured to engage the inner housing and move the first retainer member toward the split ring when the lever handle is rotated.

22. A method, comprising:

coupling a post to an outer housing;

positioning the outer housing adjacent an outer wall of a structure;

rotatably connecting an outer spindle to the outer housing, the outer spindle configured for coupling to an outer handle;

positioning an inner housing adjacent an inner wall of the structure;

rotatably connecting an inner spindle to the inner housing, the inner spindle configured for coupling to an inner handle;

coupling a handle to a screw;

wherein the screw and an internal bore of the post are defined by segmented threaded regions separated by non-threaded regions;

moving the screw to a first angular orientation relative to the post;

sliding the screw through an aperture formed in the inner housing and into the internal bore of the post until the handle contacts the inner housing;

rotating the handle approximately ninety degrees (¼ turn) from the first angular orientation;

engaging the segmented threaded regions of the screw with threaded regions of the post in response to the rotating of the handle;

clamping the inner housing and the outer housing to the structure in response to threaded engagement of the screw with the post and slidingly engaging a portion of the handle with a helical surface formed on the inner housing during the rotating of the handle.

23. The method of claim 22, wherein the slidingly engaging the portion of the handle with the helical surface results in an increased clamping force between the inner housing and the outer housing.

24. The method of claim 22, further comprising moving the screw in an axial direction away from the outer housing as the handle moves along the helical surface from a first end toward a second end during the rotating of the handle.

25. A lock assembly, comprising:

an inner housing positionable on one side of a structure and including a handle receiving region with an aperture extending therethrough;

an inner spindle rotatably connected to the inner housing and configured for coupling to an inner handle;

an outer housing positionable on an opposite side of the structure and including an opening formed therein;

an outer spindle rotatably connected to the outer housing and configured for coupling to an outer handle;

an elongate rod extending through the aperture in the inner housing and into the opening in the outer housing; and a handle connected to one end of the elongate rod; and wherein the elongate rod is configured to slide axially within the opening of the outer housing in a first angular orientation until the handle engages with the inner housing, the elongate rod further configured to couple the inner housing and the outer housing to the structure when rotated approximately one quarter of a full turn (90 degrees) from the first angular orientation to a second angular orientation to interconnect the inner housing with the outer housing; and wherein rotation of the elongate rod between the first angular orientation and the second angular orientation causes sliding engagement between the handle and the inner housing along a helical surface to provide an increased clamping force between the inner housing and the outer housing.

26. The lock assembly of claim 25, wherein the elongate rod comprises:

a clamp shaft with first and second retainer members located on either end;

a hollow post positioned about the clamp shaft; and a split ring positioned about the clamp shaft between the hollow post and the second retainer member.

27. The lock assembly of claim 26, wherein split ring is configured to expand and engage an internal wall of the opening of the outer housing when the handle is rotated between the first angular orientation and the second angular orientation.

28. The lock assembly of claim 26, wherein the split ring shaft includes the helical surface configured to engage the inner housing and move the first retainer member toward the split ring when the handle is rotated.

29. The lock assembly of claim 25, wherein the elongate rod is defined by a split ring shaft configured to expand and engage an internal portion of the opening of the outer housing when the handle is rotated between the first angular orientation and the second angular orientation.

30. The lock assembly of claim 25, wherein the elongate rod comprises a screw defined by a shank with a pair of opposite threaded portions formed in approximately 90° angular segments, and non-threaded portions located between the threaded portions;

wherein the opening of the outer housing comprises an internal bore of a post which includes a pair of opposite threaded portions formed in approximately 90° angular segments and non-threaded portions located between the threaded portions; and wherein the screw is configured to slide axially within the bore of the post in the first angular orientation and to be threadingly engaged within the bore of the post when in a second angular orientation.

31. The lock assembly of claim 25, wherein the elongate rod comprises a screw having alternating threaded portions and non-threaded portions intermittently formed about a shank; and wherein the lock assembly further comprises a post engaged with the outer housing, the post including alternating threaded portions and non-threaded portions formed therein; and wherein the screw is configured to slidingly move within the bore of the post in the first angular orientation and threadingly engage the post in a second angular orientation.

32. The lock assembly of claim 31, wherein the screw couples the inner housing and the outer housing to the structure when rotated approximately one quarter revolution)(90°) from the first angular orientation to the second angular orientation.

33. The lock assembly of claim 31, wherein the handle is connected to the screw at one end thereof;

wherein the inner housing includes a handle channel formed at least partially in a base wall and a shaped sidewall extending between the base wall and a top wall of the inner housing; and wherein the shaped sidewall and a shape of the handle are substantially similar to one another.

34. The lock assembly of claim 31, wherein the handle is connected to the screw at one end thereof; and wherein the handle receiving region includes the aperture extending through a side wall of the inner housing;

wherein the helical surface comprises:

a first helical surface formed partially around the aperture and extending between first and second ends; and a second helical surface formed partially around the aperture and extending between first and second ends; and wherein a height of the first helical surface and the second helical surface relative to the side wall increases from the first end to the second end of each of the first helical surface and the second helical surface.

* * * * *